United States Patent [19]

Arentzen

[11] 4,178,174

[45] Dec. 11, 1979

[54] DIRECT PRODUCTION OF COPPER METAL

[75] Inventor: Charles Arentzen, Tucson, Ariz.

[73] Assignee: The Anaconda Company, Denver, Colo.

[21] Appl. No.: 971,084

[22] Filed: Dec. 19, 1978

Related U.S. Application Data

[63] Continuation-in-part of Ser. No. 827,359, Aug. 24, 1977, Pat. No. 4,148,630.

[51] Int. Cl.[2] ..... C22B 15/00

[52] U.S. Cl. ..... 75/74

[58] Field of Search ..... 75/72–76, 75/92

[56] References Cited

U.S. PATENT DOCUMENTS

| | | | |
|---|---|---|---|
| 2,668,107 | 2/1954 | Gordon et al. | 75/74 |
| 3,102,806 | 9/1963 | Zimmerly | 75/74 |
| 3,326,671 | 6/1967 | Worner | 75/92 X |
| 3,427,151 | 2/1969 | Kondelka et al. | 75/76 |
| 3,459,415 | 8/1969 | Holeczy et al. | 75/72 X |
| 3,463,472 | 8/1969 | Worner | 75/92 X |
| 3,701,648 | 10/1972 | Ashby et al. | 75/72 |
| 3,725,044 | 4/1973 | Morisaki et al. | 75/74 |
| 3,796,568 | 3/1974 | Szekely et al. | 75/72 |

*Primary Examiner*—M. J. Andrews

*Attorney, Agent, or Firm*—Pennie & Edmonds

[57] ABSTRACT

The invention disclosed is a process for the direct production of copper metal by directing an aqueous slurry of cupriferous material into a molten cupriferous bath maintained at a temperature of 2100° to 2400° F. Neither the cupriferous material of the slurry nor that of the bath contains sufficient sulfidic materials to maintain the bath temperature by oxidation of these sulfides, so a carbonaceous fuel is incorporated in the slurry. Such fuel-containing slurry together with an oxygen-containing gas is directed at high velocity against the bath surface at an angle of about 20° to 40° from the horizontal. The incorporation of fuel in the injected slurry provides a heat source for the maintenance of the 2100° to 2400° temperature necessary for smelting the cupriferous material of the slurry.

5 Claims, 3 Drawing Figures

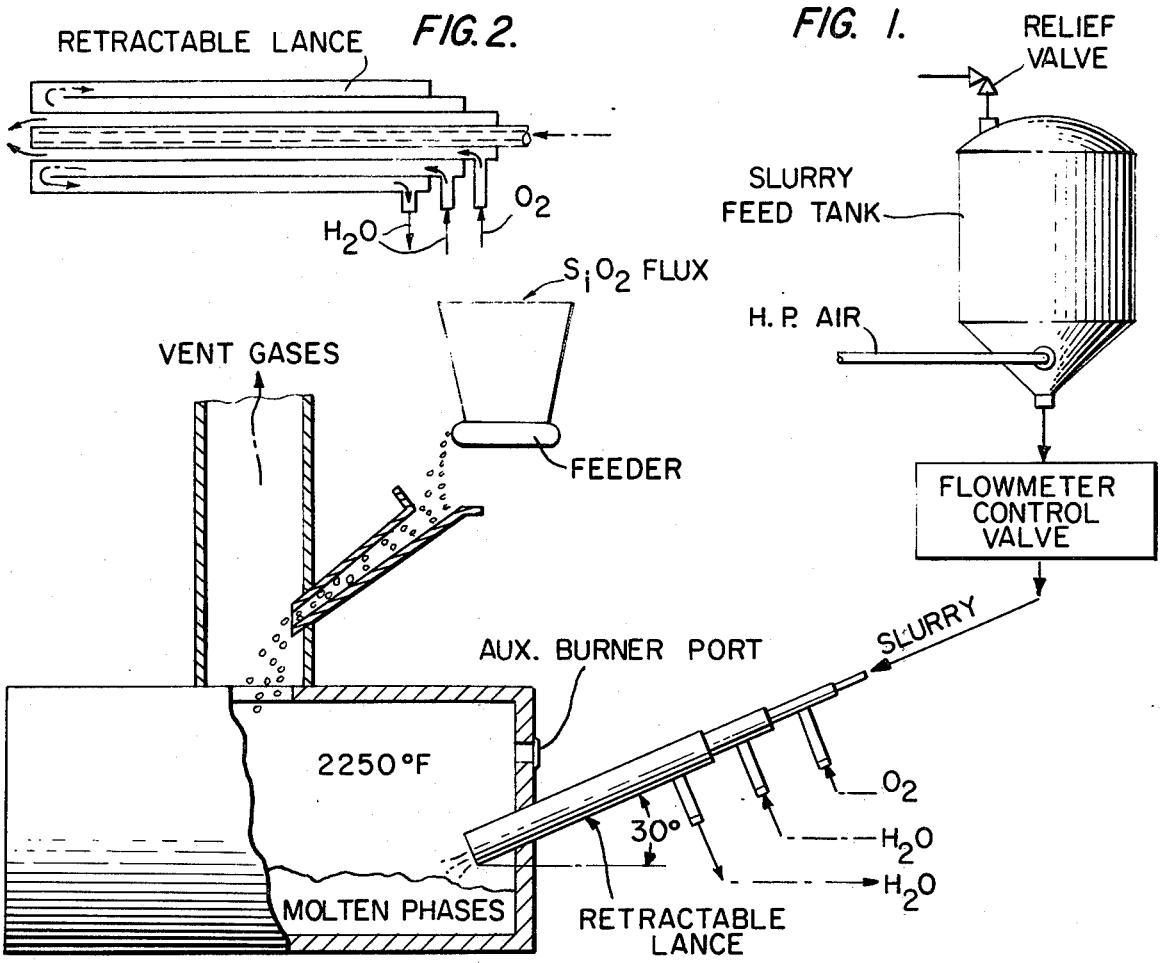
FIG. 2.
RETRACTABLE LANCE
$H_2O$
$O_2$
FIG. 1.
RELIEF VALVE
SLURRY FEED TANK
H. P. AIR
FLOWMETER CONTROL VALVE
SLURRY
$S_iO_2$ FLUX
FEEDER
VENT GASES
AUX. BURNER PORT
2250°F
MOLTEN PHASES
30°
$O_2$
$H_2O$
$H_2O$
RETRACTABLE LANCE
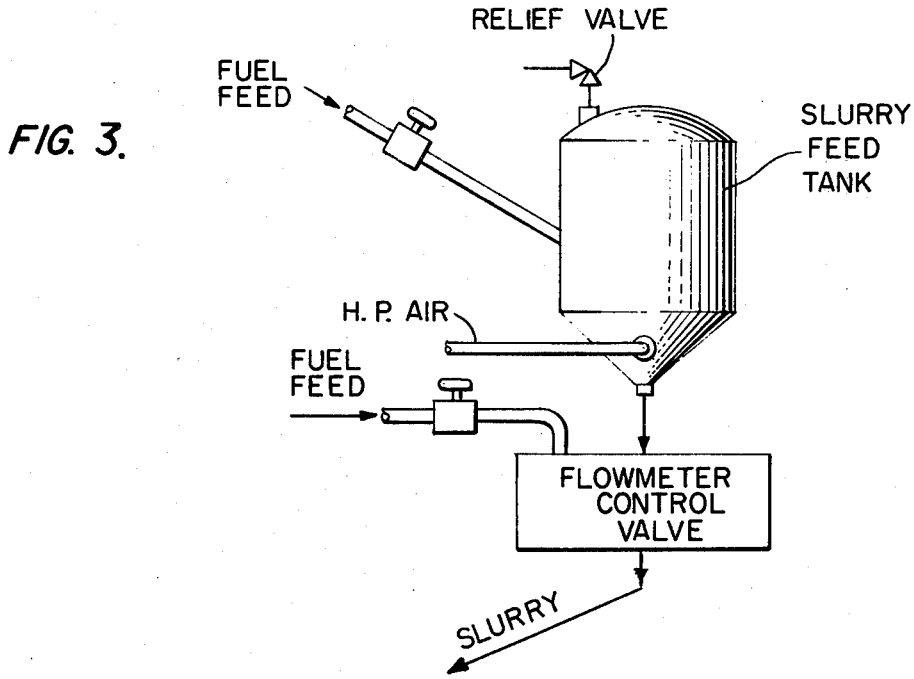
FIG. 3.
RELIEF VALVE
FUEL FEED
SLURRY FEED TANK
H. P. AIR
FUEL FEED
FLOWMETER CONTROL VALVE
SLURRY

DIRECT PRODUCTION OF COPPER METAL

CROSS-REFERENCE TO RELATED APPLICATIONS

This application is a continuation-in-part of application Ser. No. 827,359, filed Aug. 24, 1977, now U.S. Pat. No. 4,148,630 which is hereby incorporated by reference.

BACKGROUND OF THE INVENTION

The present invention is directed to a process for forming metallic copper of blister quality from copper-bearing material. The blister copper is readily transformed into anode copper.

The injection of oxygen and an aqueous cupriferous slurry into a smelting furance where they are directed toward a molten bath of cupriferous material maintained at a temperature of 2100° to 2400° F. to produce metallic copper is disclosed in the parent application, Ser. No. 827,359, mentioned above. This method of copper smelting can be referred to as the oxygen-slurry process. The basic concept of the oxygen-slurry process is the continuous production of metallic copper autogenously from the cupriferous material of the slurry. The process of the aforesaid application depends on the presence in the slurry or in the bath of sufficient sulfidic copper material to maintain by its oxidation the necessary high bath temperature. The process is described in the application, therefore, as involving the presence in the slurry of sufficient copper concentrates (copper sulfides) or the presence in the bath of sufficient matte ($Cu_2S+FeS$) or both, to develop and maintain the necessary bath temperature by oxidation of the sulfidic material.

Not all cupriferous feed materials which may be used to produce copper are adequately sulfidic for this process. For example, if the cupriferous material present in the feed slurry is cold solidified white metal (substantially pure $Cu_2S$) or high-grade copper concentrates or solidified matte (containing relatively little iron sulfides), or cement copper precipitates (impure metallic copper precipitated on scrap iron) there will exist a heat deficiency which must be supplied by other means.

The Szekely et al U.S. Pat. No. 3,796,568 describes a process for flame smelting of cement copper precipitates by forming a slurry of such precipitates in a liquid hydrocarbon fuel, and injecting such slurry through a burner into a combustion chamber wherein the fuel is burned, impurities are oxidized or vaporized, and the copper is melted. The copper is collected in a pool at the base of the combustion chamber. It should be noted that the Szekely et al teaching does not contemplate incorporation of the fuel into an aqueous slurry, or directing such slurry against a molten cupriferous bath at high velocity so as to effect smelting within the bath.

SUMMARY OF THE INVENTION

The present invention is directed to a modified oxygen slurry process for the direct production of metallic copper from cupriferous materials which are deficient in sulfides and so are not autogenic and require secondary heat sources.

The invention, therefore, provides a process for the direct production of copper metal by directing an aqueous slurry of cupriferous meterial into a molten bath of cupriferous material at a temperature of about 2100° to 2400° F., wherein neither the cupriferous material of the slurry nor the cupriferous bath contain sufficient sulfides to maintain the bath temperature by oxidation of the sulfides. A carbonaceous fuel is incorporated in such slurry of cupriferous material, and an oxygen-containing gas together with the fuel-containing cupriferous slurry is then injected into the molten bath in the form of a high-velocity stream of gas and slurry directed at the bath at an angle of about 20° to 40° from the horizontal. Resulting slag and metallic copper are separately withdrawn from the bath. The proportion of slurry and oxygen are adjusted with respect to the energy supplied by the fuel to establish and maintain operation at the specified temperature of from about 2100° to about 2400° F.

BRIEF DESCRIPTION OF THE DRAWINGS

In the drawings:

FIG. 1 is a schematic view, partly in section, of an apparatus system suitable for carrying out the instant process.

FIG. 2 is an enlarged sectional view of the retractable lance depicted in FIG. 1, and FIG. 3 is an enlarged sectional view of the fuel-slurry mixing system.

DETAILED DESCRIPTION OF THE INVENTION

This invention will be described in connection with the drawings showing an apparatus system suitable for carrying out the invention. The cupriferous materials which may be treated by the present invention include copper sulfides and high grade copper concentrates, neither of which are sufficiently rich in sulfides to fuel a smelting operation. Also included are non-sulfidic materials such as cement precipitates, oxidized copper ores and residues, and leach residues remaining after an acidic of other leach of mixed copper oxide-sulfide ores and the like. Copper concentrates and other high sulfur materials may also be included in the slurry feed, but in amounts less than sufficient for their sulfide content to fuel completely the smelting operation.

Such cupriferous materials are first formed into a slurry by being admixed with water. For processing convenience, the slurry can be maintained in a slurry feed tank from which it is conducted to a smelting furnace 20. A flowmeter control valve can be suitably used to control the amount of slurry being fed to the furnace for continuous operation as hereinafter described.

The furnace 20 can be any conventional reverberatory or other smelting furnace used in the smelting of copper materials, or it may even be a converter such as a Peirce-Smith converter. The furnace is initially charged with a body of molten cupriferous material, preferably high grade matte or white metal, containing too little sulfur to fuel the smelting reactions.

The slurry is formed by mixing the solids with water to about 25% water, more or less, based on total weight of the mixed slurry. The slurry is then screened on a 4 or 8 mesh screen to remove coarser sizes. A larger mesh screen may be utilized so long as the coarser sized materials do not plug the slurry delivery system used.

It is characteristic of the invention that a carbonaceous fuel also is incorporated in the slurry. Such fuel may be a liquid hydrocarbon such as fuel oil, or it may be a solid such as coke or coal. If it is a liquid that is normally immiscible with the aqueous medium, a surfactant may be used to facilitate incorporating it into the slurry. The amount of carbonaceous fuel added is sufficient to supply upon combustion enough heat, in addition to that supplied by oxidation of sulfide components of the slurry or the molten cupriferous bath in the furnace 20, to maintain the bath temperature at the desired high value (2100° F. to 2400° F., and preferably 2200° F. to 2300° F.).

The slurry may, in addition, contain other materials which are normally present during smelting operations. Such materials include fluxes such as silica, lime, and the like. In the alternative, such additives may be introduced separately into the molten bath of the smelter furnace by means of separate feeders as is shown in FIG. 1.

Concurrently with the introduction of the slurry to the molten bath, it is required to inject an oxygen-containing gas into the molten bath in the smelting furnace. The oxygen-containing gas is injected concurrently with the copper slurry either via separate lances which project through the side wall of the furnace, or by the utilization of a single lance as shown in FIGS. 1 and 2 having at least one pair of concentrically arranged feeder tubes. Each tube separately carries the oxygen-containing gas and the slurry, respectively. The oxygen-containing gas should contain a high concentration of oxygen therein, and it is preferred, therefor, that it be substantially pure oxygen, such as commercially pure oxygen. By utilizing substantially pure oxygen feed, one more readily obtains the necessary thermal conditions.

The injection of the slurry and gas must be accomplished at a high velocity to ensure prompt and intimate admixture of the slurry and gas with the molten material. This is best accomplished by the use of a lance or lances. These are used to introduce the slurry and oxygen gas into the smelter furnace and are preferably retractable and project at an angle to the horizontal through the side walls of the furnace. The lance is arranged to direct both the oxygen-containing gas and the slurry at an angle between 20° and 40° and most suitably 30°, with respect to the horizontal. Thereby the combined flow of oxygen gas and slurry material is caused to impinge upon and penetrate beneath the surface of the molten material in a manner which causes substantial mixing of the slurry with the molten material. Also, by so directing the gas and slurry, there is no tendency to form accretions, by splashing on the lance or by charge accumulation on the furnace walls, which might impair operations of the lance or efficient smelting of the feed. The particular injection velocity necessary for most efficient operation will vary depending upon the material used, but can be readily determined by making trial runs to ascertain optimum conditions. Water can be circulated through the lance, or lances, to minimize heat damage due to the smelter temperatures.

The smelter furnace may contain tapholes (not shown) at various locations to permit the withdrawal of both molten metallic copper and slag from the smelting furnace. Molten copper of blister quality is thus formed within the furnace. After tapping from the furnace it can be readily fire refined and cast into anodes for processing by electrolytic methods to form cathode copper of high quality. A portion of the slag material can be recycled in a subsequent furnace charge, or treated by other conventional processes within the smelter plant. Gaseous products formed within the smelter furnace are predominantly sulfur dioxide and water vapor along with combustion products from the fuel used. These gaseous products (vent gases) may be handled separately or may be combined with the gas streams of conventional smelters and converted to sulfuric acid in accordance with conventional practice.

As molten copper and slag are withdrawn, the molten bath in the furnace is replenished by smelting of the slurry or may be replenished by charging additional quantities of matte or white metal, so that the volume of the molten cupriferous charge is maintained substantially constant.

The process of the present invention is normally employed as a continuous operation. The amount of fuel that must be added to the slurry can be readily calculated by those skilled in this art once the particular cupriferous feed is known. Smelting temperatures of about 2100° F. to 2400° F. then are maintained by regulating the amount of slurry injected and the flow rate of oxygen.

EXAMPLE

Molten copper matte assaying 52 percent copper is charged into a converter at 2200° F. A feed and gas injection lance projecting at 30° with respect to the horizontal extends into the converter to direct feed toward the surface of the molten bath.

A slurry is formed from 100 parts cement copper precipitates and high grade copper concentrates, 15 parts $SiO_2$ and 3 parts limestone with 30 parts water. Sufficient fuel oil, in the form of a water-dispersable emulsion, is incorporated into the slurry to provide the heat necessary for maintaining the converter charge temperature upon injection of the slurry into the converter. The slurry feed, together with commercial oxygen gas, is delivered at high velocity through the lance and caused to impinge on the surface of the molten bath. The furnace temperature is monitored and maintained by adjusting the fuel additions used in making up the slurry.

Slag is skimmed from the converter charge and molten copper is poured from time to time. The bath volume is maintained by the continuous injection and smelting of the cupriferous slurry for a continuous operation. What is claimed is:

1. A process for the direct production of copper metal by directing an aqueous slurry of cupriferous material into a molten bath of cupriferous material at a temperature of about 2100° F. to 2400° F., wherein neither the cupriferous material of the slurry nor the cupriferous bath contain sufficient sulfides to maintain the bath temperature by oxidation of the sulfides, which comprises:

(a) incorporating in the slurry of cupriferous material a carbonaceous fuel;

(b) injecting oxygen-containing gas and the fuel-containing cupriferous slurry into the molten bath in the form of a high-velocity stream of the gas and slurry directed at the surface of the bath at an angle of from about 20° to 40° from the horizontal; and (c) separately withdrawing the resulting slag and metallic copper from the bath, the proportion of slurry and volume of oxygen injected being adjusted with respect to the energy supplied by the fuel to establish and maintain operation at a temperature range of from about 2100° to 2400° F.

2. The process according to claim 1 wherein the oxygen gas is commercially pure oxygen.

3. The process according to claim 1 wherein the cupriferous material comprises at least one of thegroup consisting of white metal, matte, and cement copper.

4. The process of claim 1 wherein the cupriferous slurry includes sulfidic copper concentrates in amount insufficient to maintain the bath temperature by oxidation of sulfides.

5. The process of claim 1 wherein the smelting temperature is maintained from about 2200° F. to about 2300° F.

* * * * *